United States Patent [19]

Martinez

[11] Patent Number: 4,799,686

[45] Date of Patent: Jan. 24, 1989

[54] BOARD GAME APPARATUS FOR A BANKING GAME

[76] Inventor: Eduardo S. Martinez, 2371 Collins Ave., Apt. B-338, Miami Beach, Fla. 33139

[21] Appl. No.: 943,501

[22] Filed: Dec. 19, 1986

[51] Int. Cl.[4] ..... A63F 3/00

[52] U.S. Cl. ..... 273/249; 273/256

[58] Field of Search ..... 273/249, 248, 250, 256, 273/251, 257, 243, 242, 252, 253, 254

[56] References Cited

U.S. PATENT DOCUMENTS

| | | | |
|---|---|---|---|
| 1,480,360 | 1/1924 | Agee, Jr. | 273/249 |
| 1,517,847 | 12/1924 | Llera et al. | 273/249 |
| 2,780,463 | 2/1957 | Salomon | 273/249 |
| 4,262,907 | 4/1981 | Ginsberg et al. | 273/249 |

FOREIGN PATENT DOCUMENTS

| | | | |
|---|---|---|---|
| 19831 | of 1911 | United Kingdom | 273/249 |
| 571667 | 9/1945 | United Kingdom | 273/249 |

*Primary Examiner*—Leo P. Picard
*Assistant Examiner*—Jessica Harrison
*Attorney, Agent, or Firm*—Richard C. Litman

[57] ABSTRACT

A game board played with pieces consisting of a generally rectangularly configured game board, a sries of consecutive game stations indicated on the board and to receive playing tokens therein representing a respective player of a game to be played, a fixed sequence of the game stations having dollars amounts indications in increased order from a start position toward a game goal, and at least one die to determine a number of steps to be advanced in play as respective players advance toward the goal. The pieces are cubes and are distinctively colored as red, blue, yellow and black.

4 Claims, 2 Drawing Sheets

BOARD GAME APPARATUS FOR A BANKING GAME

BACKGROUND OF THE INVENTION

1. Field of the Invention

The invention relates to an improved game board played with pieces, and more particularly the invention is directed to a game board played with pieces including a generally rectangularly configured game board, a series of consecutive game stations indicated on the board and to receive playing tokens therein representing respective players of a game to be played, a fixed sequence of the game stations having numeric indications in increased order from a start position toward a game goal, and at least one die to determine steps to be advanced in play as respective players advance toward the goal. The game pieces are cubes and are distinctively colored as red, blue, yellow and black.

The invention relates further to a game board device providing for arranging a determined sequence of game stations spacially distributed along a game path or roadway and having increments of increased value in the game stations from start to finish of the game along the roadway.

2. Description of the Prior art

Various prior art board games played with game pieces, and the like, as well as apparatus and method of their construction in general, are found to be known and exemplary of the U.S. prior art are the following:

U.S. Pat. No. Des. 225,345: J. J. Jaffe
U.S. Pat. No. 1,517,847: F. F. Llera et al.
U.S. Pat. No. 1,630,646: E. H. Waterman
U.S. Pat. No. 1,707,323: H. Schaffer
U.S. Pat. No. 4,227,695: C. M. Neal, Jr.

These patents or known prior uses teach and disclose various types of board games played with pieces or similar devices of sorts and of various manufactures and the like as well as methods of their construction, but none of them whether taken singly or in combination disclose the specific details of the combinations of the invention in such a way as to bear upon the claims of the present invention.

SUMMARY OF THE INVENTION

An object, advantage and feature of the invention is to provide a novel game board and play pieces with novel indicia along a game path including arranging the values of the stations in increased sequence.

Another object of the invention is directed further to a game having game stations in an inwardly directed roadway, and further providing a fixed sequence of game stations disposed spacially along a game pathway or roadway so the increment of values of the stations are increased in value from start to finish.

Another object of the invention is to provide a novel and improved method of construction of a game board played with pieces including a generally rectangularly configured game board, a series of consecutive game stations indicated on the board and to receive playing tokens therein representing respective players of a game to be played, a fixed sequence of the game stations having numeric indications in increased order from a start position toward a game goal, and at least one die to determine a number of steps to be advanced in play as respective players advance toward the goal. The pieces are cubes and are distinctively colored as red, blue, yellow and black.

Also an object of the invention is to provide a simple and direct game board apparatus and play pieces that are unique in cooperation, simple and economical to build and use and overcomes objections that may be raised in evaluation of prior known devices.

These together with other objects and advantages which will become subsequently apparent reside in the details of the process and operation thereof as more fully hereinafter is described and claimed, reference being had to the accompanying drawings forming a part thereof, wherein like numerals refer to like parts throughout.

DESCRIPTION OF A PREFERRED EMBODIMENT OF THE INVENTION

Figure 1:
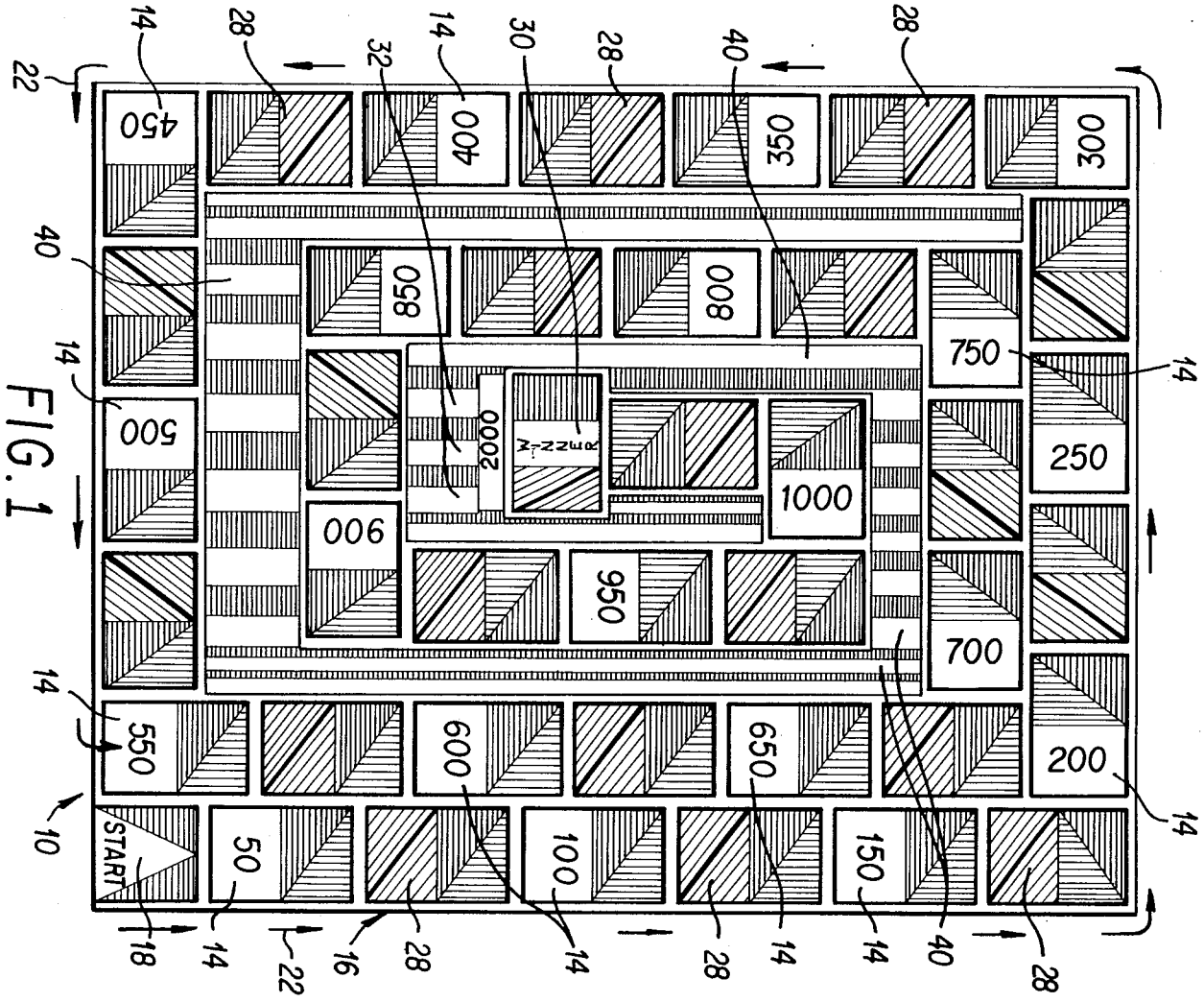
FIG. 1 is a plan view of a banker game board, sometimes called crazy banker game, and illustrating a typical construction and design thereof according to a preferred embodiment and best mode of the present invention.
Figure 2:
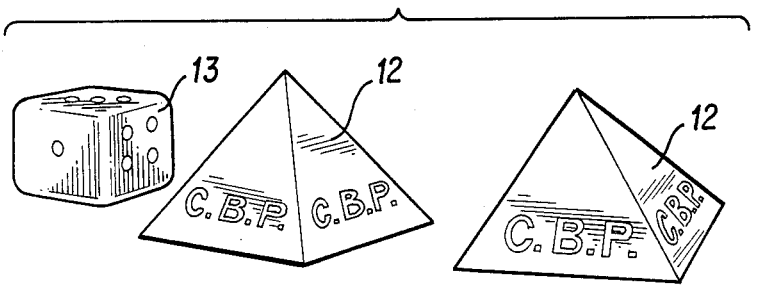
FIG. 2 shows in perspective view a set of game pieces according to the invention.
Figure 3:
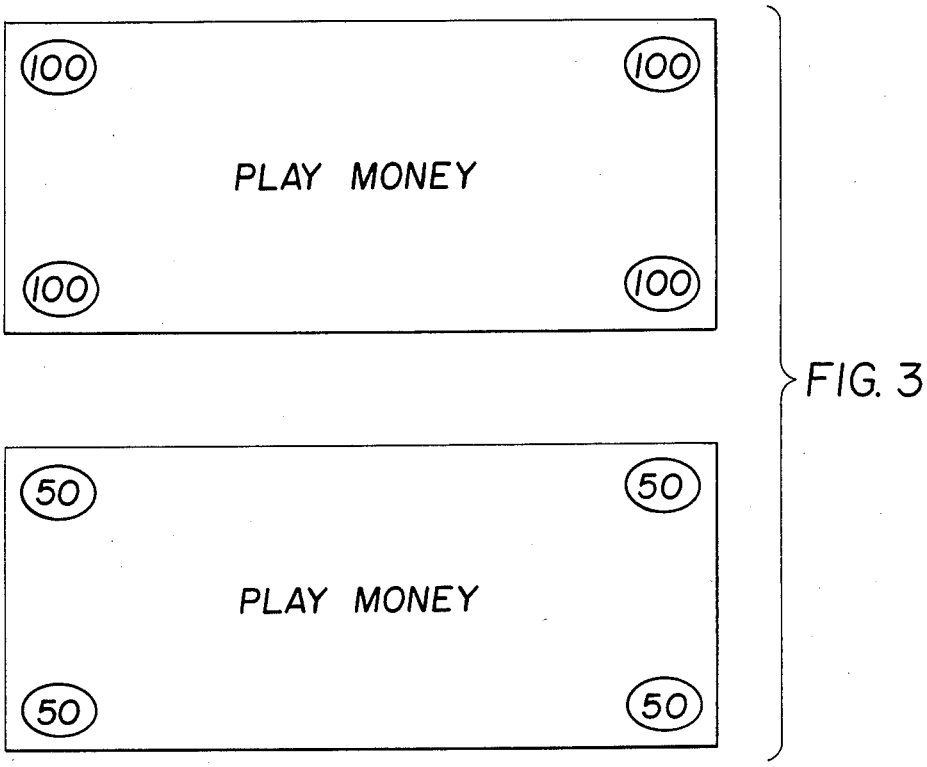
FIG. 3 typifies the toy money of the game in two of its denominations.
Figure 4:
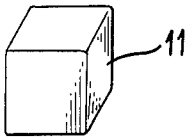
FIG. 4 is one of the playing pieces.

Referring now to the drawings there is shown in FIGS. 1 and 2 a banker game board 10 assembled of stiff, rigid materials and a set of game tokens 12 with a die 13 for play of the Crazy Banker game rules set out below. The game board is of a generally rectangular configuration as shown. A series of consecutive game stations 14 of stepped numerical values, and which may be colored yellow, are disposed along a roadway or game path 16 that commences with a start 18 and progresses along the game path 16 shown further by the arrows 22 until the game progresses to a winner location or station 30.

Interspersed among the game stations 14 are non-valued positions or stations 28 which may be colored red and blue and usually may constitute two or three or four in number between each of the stations 14. The value provided to the game stations 14 are in an ascending series of stepped values that range preferably from $50 to $1000 in increments of $50 but for the last and winner station 30 which is a double of the previous station value, i.e. $2,000, and a winner player who reaches the last and winner station 30 will be awarded $2,000. Adequate spaces are provided to indicate subsequent game scores which may be placed in spaces 32. The series of consecutive game stations 14, 28, 30 form a game path shown by arrows 22 between the start station 18 and the winner station 30 arranged in a contoured pathway 16 defining generally a spiral in configuration from a peripheral position on the game board toward the center thereof and spacer members 40 for maintaining separation of the pathway 16 are interposed between adjacent passes of the pathway.

Exemplary of the game are the rules which are set out in detail below.

RULES

1986 © Eduardo S. Martinez

This is a game having several players, one whom is the CRAZY BANKER who disperses and collects monies and this is about an imaginary banker who operates a CRAZY BANK in a very odd way with its own made peculiar rules, for example, one lends money when it should be collected or vice versa; one also gives out cash prizes to winners of the game allowing them to become partners by offering them purchase of CRAZY BANKER BRANCHES (C.B.B.) at ridiculous prices. One is a good sport as winner but when it comes to losers, one is not such a good sport as the game calls for penalizing them by taking away part or all of their monies after each game.

At times the CRAZY BANKER will see himself in financial difficulties with no money and unable to continue operations, and when this occurs the CRAZY BANKER will be automatically bankrupt and the players will count their properties to determine who is the GRAND WINNER and then the game may be started again.

How to Play

The game is played with two, three, four, or more players at a time and it consists of following a multicolored roadway of squares on a board from a start position to a final square representing the climax of the game and the winning spot.

A die is used to determine who is going to be first to play and the sequence of the players of the game in taking their turns. Thereafter the player will take turns at throwing the die to determine a number of the squares the player will advance on the roadway on the board. The direction is followed by the numerical sequence on the board starting with CRAZY BANKER BRANCHES (C.B.B.) number $50 to number $1000. Chance is a primary factor in playing of the game.

Every time a player advances and stops directly on a CRAZY BANKER BRANCH (C.B.B.) square, usually yellow, the CRAZY BANKER will open his cash vault and award that player the cash in the amount indicated on the square played in order to encourage the player to win the game and become a partner with the CRAZY BANKER. This is the manner the players will build up their resources and if, on the other hand, the player stops on a blue or red square, it will be of no consequence and the player remains there until the player's turn recurs.

A basic rule provides that if a player stops on a CRAZY BANKER BRANCH square already occupied by another player, such player will pay CRAZY BANKER the amount indicated on that square and then the player must move back one space unless that square is also occupied by another player. The player must move back still another square until the player reaches a square that is unoccupied. In steps of such retreat the player must pay CRAZY BANKER the amount indicated on the CRAZY BANKER BRANCH square. In moving forward the player collects from CRAZY BANKER except in the situation explained above when a player is already in possession of such square.

The idea of starting the players in the first game without working money is two fold, namely to make the game more challenging and to boost the players expectancy and competition early on in the game, besides the odds of collecting money right from the start is very high. In the event a player sees oneself with a debt and no money, CRAZY BANKER allows such player to get an emergency loan for the exact amount of the debt a maximum amount such as $1,000, which in turn the player will have to pay back, usually as soon as possible, with a 10% interest fee.

As the players start nearing the winning square, play tends to become more difficult, for instance, a prospective winner needing five or less squares to enter the goal will need the number on the die to come up with 5 or less in order to win or keep moving on, a six will overshoot the chances on the board having to stay there until the next turn with the die. The rule stated above helps the players left behind with a chance to get closer to the goal or either catch up or pass the leading players and to win, in some cases. The situation explained above generates a flurry of activity and excitement among the players just before finishing the game.

The player who reaches the last square first will be declared the winner and CRAZY BANKER will award the winning player $2,000. In addition the winning player will be allowed by the CRAZY BANKER to become a CRAZY BANKER PARTNER (C. B.P.) and to thereupon own a CRAZY BANKER BRANCH (C.B.B.) at the price indicated starting with the $50 one. This will be a permanent possession for the remainder of the game series thereafter and any player stopping on that private possession will have to pay the owner the fee indicated on the square. The second player to cross the winner square will be required to give half of the money collected during the game to the CRAZY BANKER. The third, fourth and any other player will have to return all their monies to CRAZY BANKER and to start the following game without capital depending on the regular method of collecting money in the game or getting emergency loans in case of debts. After the second player crosses into the winning square the third, fourth and successive players will automatically return to the starting place of the game.

There are twenty pieces or tokens described as CRAZY BANKER PARTNER (C.B.P.) pieces and they serve as markers during a game after CRAZY BANKER BRANCHES (C.B.B.)'s have been purchased. These tokens are shaped as small pyramids and will have the initials C.B.P. engraved or imprinted on each side of the token.

Bankruptcy Rule

A player who runs out of money is bankrupt, and if CRAZY BANKER BRANCHES are owned, the player should sell them to CRAZY BANKER. In the event CRAZY BANKER goes bankrupt the player owning the greatest amount of properties will be selected the Grand Winner. In the case of a tie the monies are counted and the one having the most is declared the winner.

Components of the Game 1 die 4 play pieces
20 C.B.B. signs on the board
20 C.B.P. tokens (in pyramid form to mark C.B.B. purchases)
Paper money in the following denominations:

| | | |
|---|---|---|
| 20 | $2,000 bills total | $40,000 |
| 20 | $1,000 bills total | $20,000 |
| 20 | $500 bills total | $ 10,000 |
| 50 | $200 bills total | $10,000 |
| 50 | $100 bills total | $5,000 |
| 50 | $50 bills total | $2,500 |
| 50 | $20 bills total | $1,000 |
| 50 | $10 bills total | $500 |
| 50 | $5 bills total | $250 |

One typical play of the game is by two persons, one being selected as the CRAZY BANKER, each who select a play piece 11 which is placed at the start station 18. With a throw of the die 13 by each player the order of play by turns is determined and by a subsequent throw of the die 13, the first player proceeds from the start station 18 to that number of stations shown on the die. Should the first player be positioned on an intermediate station 28 then the turn is over. On throw of the die 13 the second player proceeds from the start station 18 to that number of stations shown on the die and should that be one of the value indicated stations 14 (C.B.B.), then that player draws that sum in bills from the CRAZY BANKER. On throw of the die 13 by the first player, should the die show the first player should advance to the same station 14 (C.B.B.) occupied by the second player, the first player pays CRAZY BANKER the amount indicated on that station and the player must move back one space unless that station is also occupied by another and so continue until a station 28 is reached that is unoccupied. In steps of such retreat the second player must pay CRAZY BANKER the amount indicated on the station 14 (C.B.B.). Play is thus continued until a first player reaches the winner station 30, and a player having the largest sum is declared the winner only in the event the CRAZY BANKER goes bankrupt and the players are tied in the amount of properties owned. To determine the winner, then the money is counted as a tie breaker, but not as a common practice at the end of every game. This is generally exemplary of the rules of the game.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, which fall within the scope of the invention.

What is claimed and desired to be secured by Letters Patent is:

1. A board game apparatus for playing of a banking game for two or more players, one player being designated banker, comprising:

a plurality of playing pieces, each piece representing each player and having means to distinguish said piece of one layer from the pieces of other players;

a generally rectangularly configured game board of substantially stiff, rigid materials:

a series of consecutive game stations indicated on the board from a start station to a winner station;

said series of consecutive game stations forming a game path between the start station and the winner station and arranged in a contoured pathway defining generally a spiral configuration progressing from a peripheral position of the game board toward the center thereof;

toy printed paper money;

selected ones of the series of game stations disposed in a fixed sequence having thereon numeric indication means for transacting specific amounts of money between players and with the banker, said amounts increasing in order from the start station toward the winner station;

selected ones of the series of game stations disposed in a fixed sequence, having no numeric indications thereon, interposed between said stations having numeric indications thereon;

a plurality of playing tokens, each token representing a player's ownership of one of the selected game stations having numeric indication means thereon;

said series of consecutive game stations adapted to receive said playing pieces and tokens thereon; and at least one die to determine stations advanced by a player as players advance along the consecutive game stations toward the winner station.,

2. A board game apparatus of claim 1 further comprising a center station, wherein said center station has adequate space thereon for designating other numeric indications for use in subsequent rounds of the game.

3. A board game apparatus of claim 1 wherein said means to distinguish said pieces are differences in color on said pieces.

4. A board game apparatus of claim 1 wherein said tokens have means to distinguish each player's token.

* * * * *